United States Patent [19]

Bauer et al.

[11] 4,174,212

[45] Nov. 13, 1979

[54] METHOD FOR THE REFINING OF STEEL

[75] Inventors: Hannsgearg G. Bauer; Manfred Walter; Erick Heimrich, all of Witten, Fed. Rep. of Germany

[73] Assignee: A. Finkl & Sons Co., Chicago, Ill.

[21] Appl. No.: 885,114

[22] Filed: Mar. 10, 1978

[51] Int. Cl.[2] ..... C21C 5/34; C21C 7/10

[52] U.S. Cl. ..... 75/49; 75/59; 75/60

[58] Field of Search ..... 75/59, 60

[56] References Cited

U.S. PATENT DOCUMENTS

| | | | |
|---|---|---|---|
| 3,169,058 | 2/1965 | Nelson | 75/59 |
| 3,706,549 | 12/1972 | Knuppel | 75/60 |
| 3,751,242 | 8/1973 | Knuppel | 75/60 |
| 3,773,496 | 11/1973 | Knuppel | 75/60 |
| 3,854,932 | 12/1974 | Bishop | 75/60 |
| 3,861,888 | 1/1975 | Heise | 75/60 |
| 3,990,888 | 11/1976 | Eriksson | 75/60 |
| 4,004,920 | 1/1977 | Fruehan | 75/60 |
| 4,021,233 | 5/1977 | Johnsson | 75/60 |

*Primary Examiner*—P. D. Rosenberg

[57] ABSTRACT

A method of producing steel, particularly stainless steel with a high Cr content, having a C content of 0.03% or less which consists of firstly, lowering the C content of a molten steel bath into the preferred range of about 0.2% to about 0.4% by treating the bath with gaseous oxygen under atmospheric pressure, and secondly, subjecting the steel bath to the simultaneous effect of agitation, as by the passage of an inert gas upwardly there through, and a sub-atmospheric pressure until the C content is lowered into the desired low range.

7 Claims, No Drawings

METHOD FOR THE REFINING OF STEEL

A METHOD FOR THE REFINING OF STEEL

The invention relates to a method for the refining of steel, particularly stainless steel with a high chrome content down to low carbon contents of less than 0.03% by blowing on and/or in gaseous oxygen, on and/or into the steel heat, upon which an agitation effect is exerted by blowing in inert gas.

It was customary according to prior art to carry out both the melting and the refining of steel in the melting furnace, for example an electro light arc furnace. In the beginning of the 1960's first thoughts were given to using the furnace only for the melting and to carry out the refining and alloy operations in a subsequent assembly, for example a crucible or a converter. This offered the decisive economic advantage that the furnace could be used more strongly for its actual purpose and it could operate more economically. The batch time was reduced in half. Thus almost double the quantity could be melted in the furnace against the prior art.

In the meantime, different methods have been disclosed for refining the heat in a separate vessel. The so-called AOD method (Argon-Oxygen-Decarburization), as known for example from the German Display Copy 1,508,280, consists of blowing an argon-oxygen mixture into and through the steel heat transferred from the melting furnace into a converter. Thereby, argon, as an inert gas, has the task of reducing the partial oxygen pressure in the heat, in order to thereby increase the affinity of the oxygen toward the carbon with reference to chrome. That way the danger can be avoided that as oxygen is blown on or into a heat containing chrome the chrome oxidizes or sinters and must be replaced at the end of the refining operation.

Toward the end of the 1960's another refining process was disclosed, whereby a steel heat produced in melting furnace, for example a hot blast cupola furnace, is pre-refined in an oxygen blow-on converter and then finish-refined in a ladle degasification system under vacuum by blowing on gaseous oxygen (see "Stahl and Eisen" 88 (1968), pages 153 to 159). This prior art method made possible a decarbonization of the steel heat almost without chrome loss, down to carbon contents of less than 0.01%.

The blowing of oxygen or an oxygen-argon mixture to the surface of a steel heat located in a crucible was disclosed in the German Publication Copy 1,458,901, whereby argon or an argon-oxgyen mixture was blown through the heat. In place of argon steam or methane (German Publication Copy 2,308,469) or oil (German Publication Copy 2,033,975) also were used already.

To have the refining process progress under vacuum is a proposal dating back to the 1930's for producing ferro-chrome (German Pat. No. 676,565), which has been resumed of late in the U.S. Pat. No. 3,854,932. In both cases oxygen is blown in gaseous form to the bath surface of a heat located in a converter, whereby in case of the U.S. patent inert gas is allowed to bubble through the heat to exert an agitation effect and to activate the refining.

As mentioned already, all the methods known from prior art for the refining of steel heats containing chrome were for the purpose of inhibiting an oxidation of the chrome included in the heat. This was managed with greater or smaller success. As a rule, however, it was necessary to replace the chrome share which slacked in spite of all efforts by adding chrome in metallic form or as pre-alloy, for example ferro-chrome. It also was felt as detrimental in the prior art methods that the investment in equipment is relatively high; this applies for the first-mentioned prior art method of pre-refining in the crucible and finish-refining under vacuum in a ladle degasification installation just as well as for refining under vacuum, for example according to U.S. Pat. No. 3,854,932. Under the AOD method the high consumption of argon has a negative economic effect.

The invention is based on the problem of creating a method which is free from the mentioned disadvantages of the methods known from prior art, and to make the refining process even more economical than what is possible with the methods known from prior art.

For the solution of this problem it is proposed according to the present invention that the refining takes place with the aid of gaseous oxygen in a manner known per se, at first at atmospheric pressure, until the carbon content has dropped to about 0.2 to 0.4%, and that immediately thereafter the heat is allowed to boil out in the same vessel under continued agitation by means of inert gas, but shutting off the supply of gaseous oxygen, through continuous reduction of the pressure above the melting path down to less than about 10 Torr, under reduction of the metal oxides formed during the refining, until the desired final carbon content has been reached.

Under the embodiment of the method according to the invention, first, in a manner known per se, the steel head containing chrome and transferred into a vessel, a converter for example, is pre-reduced under atmospheric pressure by blowing oxygen on or in, until the carbon has decreased to values above about 0.2 to 0.4%. In the same vessel the pressure is then reduced continuously after interruption of the oxygen supply, while the heat is continuously bubbled through with inert gas for agitation, until the pressure has reached 10 Torr. At this pressure the steel heat is allowed to boil out until the desired final carbon content has been reached.

It has been discovered, surprisingly, that the chrome and manganese oxides formed inevitably during the refining are reduced while the heat is allowed to boil out, so that the heat is re-alloyed from its own chrome and manganese. When the method according to the invention is used, an addition of these metals for replenishment of the share slacked during the refining thus is no longer necessary in the scope heretofore required, if prior to the refining the steel analysis has been adjusted to the final contents. The reduction of chrome and manganese oxydes occurring while the heat is allowed to boil out can be seen from the following table:

| Composition of the Steel Bath | After Refining Prior to Application of Vacuum | After Vacuum Treatment |
|---|---|---|
| C | 0.25% | 0.013% |
| Mn | 0.99% | 1.11% |
| Cr | 16.34% | 16.73% |
| $O_2$ | 650 ppm | 420ppm |
| Fe | remainder | remainder |
| Temperature | 1780° C. | 1724° C. |

As the table shows, the chrome content increases, as contrasted to prior to the vacuum treatment, from 16.35% to 16.73%; and the manganese content from 0.99% to 1.11%. Since chrome and manganese were not added during the vacuum treatment, this increase can be attributed only to reduction of chrome and manganese oxides from the slag above the steel bath. The oxygen released during the chrome reduction causes further reduction of the carbon content in the heat.

If the carbon content is to be reduced to values of less than 0.02%, it is possible, according to an advantageous improvement of the method according to the invention, to add, while the heat is allowed to boil out, oxides, preferably in the form of iron sinters, or to extend the boil-out time under vacuum. Through the reduction of these oxides oxygen is released which under bonding with carbon promotes the decarburization.

The boiling out under vacuum takes place at temperatures above 1700° C. The time required therefor is about 15 minutes, whereby the loss of temperature taking place during that time is approximately 60° C.

The advantage of the method according to the invention against those known from prior art which are carried out in two different vessels and/or assemblies resides in the lower investments in equipment and time compared with the refining methods known from prior art with the application of vacuum.

The method according to the invention offers the following advantages:

A discharge-free refining is possible. No splashes baking to the converter opening are created, as occurs in the case with refining under vacuum and therefore the vacuum covering hood can be placed on with the perfect sealing.

The pumping capacity for generating the vacuum may be less than in corresponding assemblies, required for the embodiment of the known methods progressing entirely under vacuum, because the generation of the vacuum at the end of the refining process no longer requires the pumping off of as much gas as necessary during the blowing on of oxygen during the refining.

The possibility of reduction of the chrome and manganese slacked during the refining in the methods of prior art is not possible in the same scope as with the embodiment of the method according to the invention. Thus, in a very simple manner relatively expensive alloying or reduction metal can be saved.

We claim:

1. In a method of making stainless steel having a carbon content of 0.03% or less, the steps of adding gaseous oxygen to a heat of molten steel containing carbon and chromium until the carbon content of the heat has decreased to about 0.2% to 0.4%, said gaseous oxygen being added at atmospheric pressure, terminating the addition of gaseous oxygen after the carbon content of the heat has dropped to about 0.2% to about 0.4%, and thereafter subjecting the heat containing about 0.2% to 0.4% carbon to the simultaneous effects of, firstly, inert gas agitation, and, secondly, sub-atmospheric pressure, until the desired final carbon content is reached.

2. The invention defined in claim 1 further characterized in that the gaseous oxygen is blown against the surface of the heat during the gaseous oxygen addition treatment.

3. The invention defined in claim 1 further characterized in that the absolute pressure to which the heat is subjected is reduced to 10 Torr during the simultaneous inert gas agitation—sub-atmospheric pressure.

4. The invention defined in claim 1 further including the step of adding oxygen in solid oxide form during the simultaneous inert gas agitation—sub-atmospheric pressure treatment.

5. In a method of making stainless steel having a carbon content of 0.02% or less, the steps of adding gaseous oxygen to a heat of molten steel containing carbon and chromium until the carbon content of the heat has decreased to about 0.2% to 0.4%, said gaseous oxygen being added at atmospheric pressure, terminating the addition of gaseous oxygen after the carbon content of the heat has dropped to about 0.2% to 0.4%, thereafter subjecting the heat containing about 0.2% to 0.4% carbon to the simultaneous effect of, firstly, inert gas agitation and, secondly, sub-atmospheric pressure, and adding oxygen in solid oxide form at a time during which the heat is subjected to the simultaneous inert gas agitation—sub-atmospheric pressure treatment.

6. The invention defined in claim 5 further characterized in that the gaseous oxygen is blown against the surface of the heat during the gaseous oxygen addition treatment.

7. The invention defined in claim 6 further characterized in that the heat is subjected is reduced to 10 Torr during the simultaneous inert gas agitation—sub-atmospheric pressure treatment.

* * * * *